United States Patent [19]

Pritza

[11] 3,985,924

[45] Oct. 12, 1976

[54] ARTIFICIAL CHRISTMAS TREE

[75] Inventor: Mike Pritza, Rock Springs, Wyo.

[73] Assignee: The Raymond Lee Organization, Inc., New York, N.Y. ; a part interest

[22] Filed: Mar. 17, 1975

[21] Appl. No.: 558,850

[52] U.S. Cl. ..... 428/9; 428/20; 240/10 T; 248/356

[51] Int. Cl.[2] ..... A47G 29/00; A47G 33/08; A47G 33/16; F21P 1/02

[58] Field of Search ..... 428/7, 9, 18, 20, 19; 240/10 T; 248/356

[56] References Cited

UNITED STATES PATENTS

| | | | |
|---|---|---|---|
| 2,214,046 | 9/1940 | Doran | 428/20 |
| 2,903,227 | 9/1959 | Key | 248/356 |
| 2,937,842 | 5/1960 | Meek | 248/356 |
| 2,991,040 | 7/1961 | Levy | 248/356 |
| 3,143,331 | 8/1964 | Corey | 248/356 |
| 3,595,209 | 7/1971 | Parker | 248/356 |
| 3,603,780 | 9/1971 | Lu | 240/10 T |
| 3,820,694 | 6/1974 | Pabis | 248/356 |
| 3,822,850 | 7/1974 | Elias | 248/356 |

*Primary Examiner*—Philip Dier
*Attorney, Agent, or Firm*—Howard I. Podell

[57] ABSTRACT

A Christmas Tree formed of collapsible sections of trunk and branches with electrical lights mounted in sockets on each branch. Electrical conductors run from a portable supply cord joining the base of the trunk through the trunk and branches with the individual sections of the tree joined together by plug and socket fittings that form both mechanical and electrical connection of the joined members. The top section of the trunk is fitted with a spring-biased member that rests against a ceiling to hold the trunk in a vertical position, with the base of the trunk resting on the floor or other support surface. A multi-pole switch is fitted on the portable supply cord for switching various combinations of tree lights.

2 Claims, 4 Drawing Figures

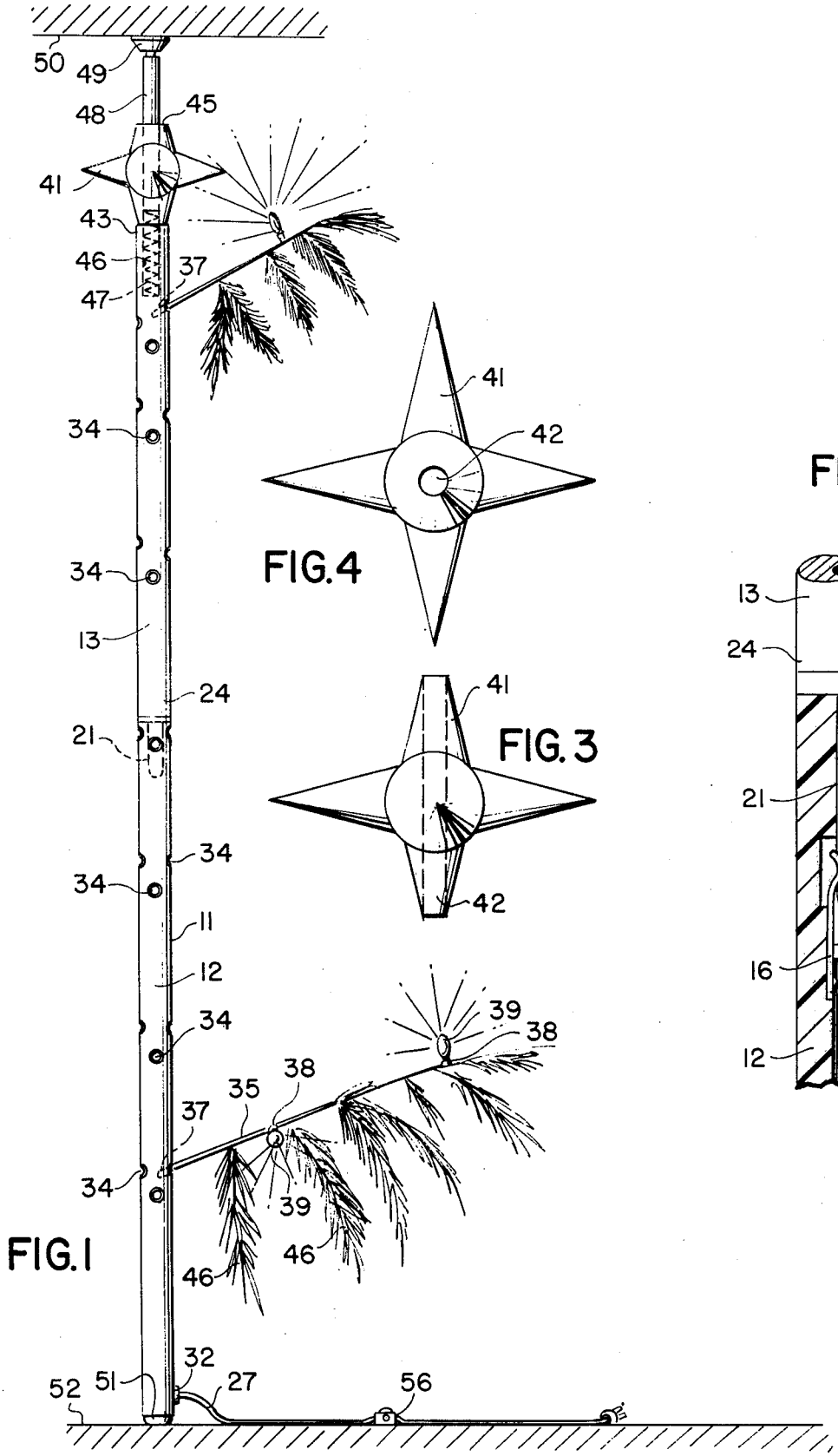
FIG. 1
FIG. 4
FIG. 3
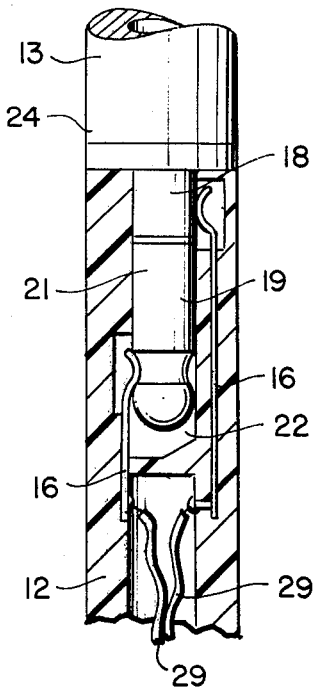
FIG. 2

ARTIFICIAL CHRISTMAS TREE

SUMMARY OF THE INVENTION

My invention is a Christmas tree formed of collapsible sections of trunk and branches with electrical lights mounted in sockets on each branch. Electrical conductors run from a portable supply cord joining the base of the trunk through the trunk and branches with the individual sections of the tree joined together by plug and socket fittings that form both mechanical and electrical connection of the joined members. The top section of the trunk is fitted with a spring-biased member that rests against a ceiling to hold the trunk in a vertical position, with the base of the trunk resting on the floor or other support surface. A multi-pole switch is fitted on the portable supply cord for switching various combinations of tree lights.

An electrically illuminated star may be mounted on the top section of the trunk.

BRIEF DESCRIPTION OF THE DRAWINGS

The objects and features of the invention may be understood with reference to the following detailed description of an illustrative embodiment of the invention, taken together with the accompanying drawings in which:

FIG. 1 is an elevation view of an erected tree trunk and several tree branches;

FIG. 2 is a sectional view of the detachable electrical and mechanical connection between trunk sections.

FIG. 3 is a plan view of a decorative object mounted on the tree trunk; and

FIG. 4 is a side view of the decorative object.

DESCRIPTION OF THE PREFERRED EMBODIMENT

Turning now descriptively to the drawings, in which similar reference characters denote similar elements throughout the several views, FIG. 1 is a view of the assembled tree trunk 11 formed of a base section 12 and a ceiling section 13. Sections 12 and 13 are joined together as shown in FIG. 2. A cylindrical metal plug 21 extends from the joined end 24 of the ceiling section 13 into a mating axial hole 22, with metal plug 21 formed of two metal members 18 and 19 electrically insulated from each other that each engage a female metal electrical contact 16, with each contact 16 joined to one of the two supply wires 29 running through an axial hole in the base section 12 leading to a portable line cord 27 that leads out of the lower side portion 32 of the base member 12. Wires 29 are connected to similar female electrical contacts in socket holes 34 into which the ends 37 of individual branches 35 snugly fit, with each branch end 37 fitted with a male plug 21. Wires lead in each branch 35 from male plug 21 to the sockets 38 mounted on the branch in which light bulbs 39 are individually fitted. Branch sections 35 are each shaped with projections 46 to simulate foliage. Ceiling Trunk section 13 is similarly fitted with socket holes 34 joined electrically to the plug 21 at the end 24 of trunk section 13.

As shown in FIGS. 1, 3 and 4, a decorative star shaped object 41 is fitted with an axial hole 42 to snugly fit over the upper section 43 of ceiling trunk section 13.

An axial hole 46 at the upper end 45 of ceiling trunk section 13 is fitted with a compression spring 47 that bears against a slidable plunger 48 that extends beyond trunk end 45 to rest, in the installed position, against the surface of the ceiling 50, forcing the lower end 51 of base trunk section 12 against the floor 52 to hold the trunk 11 erect. A soft disc 49 is fitted to the free end of plunger 48 to bear against the surface of ceiling 50.

Portable line cord 27 is fitted with a switch 56 for controlling lights 39. If desired, switch 56 may be of a multipole, multiposition switch to switch ON or OFF various combinations of lights 39, with necessary circuit wires carried inside of trunk 11 and distributed to selected socket holes 34. Decorative Object 41 may be fitted with electrical illumination means connected by wires to a plug which fits into a socket hole 34.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An artificial Christmas tree formed of attachable sections of tubular members which form the tree trunk and attachable sections, each attachable section shaped as a tree branch which may be attached to one of a plurality of radial holes fitted in the tubular members, with a spring-biased plunger slidably mounted in an axial hole in the upper end of the top-most tubular member to rest against the ceiling surface when the base section of the lowermost member rests against a horizontal supporting surface, together with a decorative star-shaped ornament fitted with a through axial hole that mounts about the said upper end of the top-most tubular member.

2. An artificial Christmas tree formed of attachable sections of tubular members which form the tree trunk, and attachable sections each shaped as a tree branch which may be attached by an attachable end to one of a plurality of radial holes fitted in the tubular members, in which electrical wires are fitted in the interior of each said tubular member and the interior of the attachable sections, with the electrical wires in one tubular member, which serves as the lower-most section of the assembled tree trunk, joined at the lower end of said tubular member to an external portable electrical line cord, and the electrical wires in the interior of each of the attachable sections joined to lamp bulb sockets mounted on said attachable hollow sections, a first tubular member fitted, at the end of said first tubular member that is attachable to an end of an adjoining second tubular member, with a male plug of a shape to mechanically mate with a female socket mounted on the adjoining attachment end of said second tubular member, said male plug and said female socket each connected to the electrical wires in the respective tubular members to which they are mounted and said male plug and said female socket fitted with electrical connection means to join individually the wires in the first tubular member to the wires in the second tubular member in the joined state so that the said male plug and female sockets form a detachable mechanical and electrical joint in the mated condition of the tubular members said tubular members each fitted in a said radical hole with a female socket joined to the electrical wires in the associated tubular member, with said socket shaped so as to mate with a plug fitted on the attachable end of an attachable section, said plug joined to the electrical wires in the interior of the said section, and said plug and said socket shaped to form a mechanical joint between said attachable section and a joined tubular member and an electrical connector between the wires in the said attachable section and the joined tubular member.

* * * * *